US010427912B2

(12) United States Patent
Altenburger et al.

(10) Patent No.: US 10,427,912 B2
(45) Date of Patent: Oct. 1, 2019

(54) ELEVATOR SYSTEM

(71) Applicant: ThyssenKrupp Elevator AG, Essen (DE)

(72) Inventors: Bernd Altenburger, Neuhausen (DE); Holger Zerelles, Leinfelden-Echterdingen (DE); Darrell Hertel, Aichtal (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 15/025,595

(22) PCT Filed: Sep. 30, 2014

(86) PCT No.: PCT/EP2014/002653
§ 371 (c)(1),
(2) Date: Mar. 29, 2016

(87) PCT Pub. No.: WO2015/043767
PCT Pub. Date: Apr. 2, 2015

(65) Prior Publication Data

US 2016/0207738 A1 Jul. 21, 2016

(30) Foreign Application Priority Data

Sep. 30, 2013 (DE) ..... 10 2013 219 825

(51) Int. Cl.
*B66B 7/06* (2006.01)
*B66B 7/08* (2006.01)
*B66B 11/02* (2006.01)

(52) U.S. Cl.
CPC ..... *B66B 7/064* (2013.01); *B66B 7/068* (2013.01); *B66B 7/08* (2013.01); *B66B 11/026* (2013.01); *B66B 11/0226* (2013.01)

(58) Field of Classification Search
CPC ..... B66B 7/064; B66B 7/068; B66B 7/08
See application file for complete search history.

(56) References Cited

U.S. PATENT DOCUMENTS 988,016 A * 3/1911 Neenan ..... B66B 7/068 187/264
1,822,153 A * 9/1931 Kinnard ..... B66B 7/064 187/413

(Continued)

FOREIGN PATENT DOCUMENTS

DE 202006000137 U 4/2006
EP 2460754 A 6/2012

(Continued)

OTHER PUBLICATIONS

International Search Report for PCT/EP2014/002653 dated Dec. 15, 2014 (dated Dec. 22, 2014).
English Abstract of DE 202006000137U.

*Primary Examiner* — Minh Truong
(74) *Attorney, Agent, or Firm* — thyssenkrupp North America, Inc.

(57) ABSTRACT

An example elevator system may include at least one elevator cage that is displaceable in an elevator shaft, a connection means that has a first elevator cage-side end and a second end, and a suspension disposed on the elevator cage. The connection means may include, for instance, a balance chain or belt. The first end of the connection means may be fastened to the suspension on the elevator cage. Further, the example elevator system may include a support unit that exerts a force on the suspension that counteracts a force acting on the suspension due to a mass of the connection means. The support unit may include a rope, a deflection roller, and a counterweight, wherein the rope is fastened to the counterweight and the suspension and is guided over the deflection roller.

18 Claims, 5 Drawing Sheets

(56) References Cited

U.S. PATENT DOCUMENTS

| | | | | | |
|---|---|---|---|---|---|
| 1,861,908 | A * | 6/1932 | Culp | B66B 7/08 | 187/411 |
| 5,255,759 | A * | 10/1993 | Kasai | B66B 7/064 | 187/413 |
| 5,437,347 | A * | 8/1995 | Biewald | B66B 7/10 | 187/264 |
| 6,333,865 | B1 | 12/2001 | Yumura et al. | | |
| 6,786,306 | B2 * | 9/2004 | Tiner | B66B 7/064 | 187/266 |
| 9,216,881 | B2 * | 12/2015 | Banno | B66B 7/064 | |
| 9,758,344 | B2 * | 9/2017 | Fauconnet | B66B 7/064 | |
| 2006/0163010 | A1 | 7/2006 | Ogava | | |
| 2011/0266097 | A1 * | 11/2011 | Valjus | B66B 7/062 | 187/254 |
| 2012/0067674 | A1 * | 3/2012 | Legeret | B66B 17/12 | 187/404 |

FOREIGN PATENT DOCUMENTS

| | | | |
|---|---|---|---|
| GB | 113081 | A | 2/1918 |
| JP | 2000118911 | A | 4/2000 |

* cited by examiner

PRIOR ART

ELEVATOR SYSTEM

CROSS REFERENCE TO RELATED APPLICATIONS

This application is a U.S. National Stage Entry of International Patent Application Serial Number PCT/EP2014/002653, filed Sep. 30, 2014, which claims priority to German Patent Application No. DE 102013219825.6 filed Sep. 30, 2013, the entire contents of both of which are incorporated herein by reference.

FIELD

The present disclosure relates to elevator systems and, more particularly, to elevator systems that use balance chains, balance belts, balance straps, balance cables, or the like to provide data and/or power to an elevator cage.

BACKGROUND

In conventional elevator installations having an elevator cage which is displaceable in an elevator shaft, the elevator cage is guided by way of a support means, for example at least one support rope or at least one support belt, said support rope or support belt, respectively, being guided over a drive pulley and deflection rollers and being connected to a counterweight. The elevator cage and the counterweight are displaceable along respective guides in the elevator shaft. The elevator cage is configured having guide rollers which interact with the elevator cage guide.

Moreover, a connection means is connected to the elevator cage. The connection means may be a suspended cable or a support-rope weight compensation means, for example. A support-rope weight compensation means is, for example, a balance chain, a balance belt, a balance strap, or a balance cable. For example, the elevator cage is supplied with electric power by means of a suspended cable. Moreover, data may be exchanged between the elevator cage and an external computer or controller, respectively, by way of the suspended cable. The changing stress by the weight force of the support rope when the position of the elevator cage changes is compensated for by means of a support-rope weight compensation means which connects the elevator cage to the counterweight.

Both the suspended cable as well as the support-rope weight compensation means, as connection means, are typically fastened to the lower side of the elevator cage. Thus, the weight force of the connection means additionally acts on the elevator cage, this potentially leading to non-uniform stresses on the guide rollers of the elevator cage.

The suspended cable is typically fastened to the lower side of the elevator cage, on the one hand, and to or in the elevator shaft, on the other hand. By contrast, the support-rope weight compensation means is typically fastened to the lower side of the elevator cage, on the one hand, and to the counterweight, on the other hand. However, the support-rope weight compensation means may also be fastened to the other side on or in the elevator shaft.

Additionally, the connection means, for example on account of the bending radius of the connection means that has to be adhered to, mostly acts in a decentralized manner, that is to say not on the central region or on the center of gravity of the elevator cage, respectively. Depending on the position of the elevator cage in the elevator shaft, a non-uniform distribution of force and momentum on the guide rollers of the elevator cage is thus created.

In order for good traveling properties and a high level of travel comfort to be guaranteed, the elevator cage must be precisely balanced. Therefore, a compensation mass may be fastened to the elevator cage in order for this variable distribution of force on account of the connection means to be compensated for. On account thereof, a torque which is exerted by the connection means on the guide rollers of the elevator cage, for example, may be compensated for, and the stress on the guide rollers may be reduced.

However, compensation of this type by means of a compensation mass is only optimal in a specific position of the elevator cage, mostly in the center of the elevator shaft. Non-uniform distribution of force on the guide rollers continues to arise in the other positions.

The highest stresses on the guide rollers on account of the non-uniform forces and momentums caused by the connection means arise at the uppermost and lowermost positions of the elevator cage in the elevator shaft. The complete weight force of the connection means acts on the elevator cage and, on account thereof an ultimately undesirable force acts on the guide rollers, in particular in the highest position. On account of the compensation mass, a force which leads to torque and ultimately to an undesirable force on the guide rollers is likewise present in the lowest position.

Alternatively, a symmetrical force acting on the elevator cage may also be achieved by using two connection means on mutually opposite sides of the elevator cage. However, this is associated with high costs and is also often impossible for reasons of space.

Therefore, a need exists for elevator systems that minimize or eliminate stresses that a connection means of an elevator cage exerts on guide rollers of the elevator cage.

DETAILED DESCRIPTION

Figure 1A:
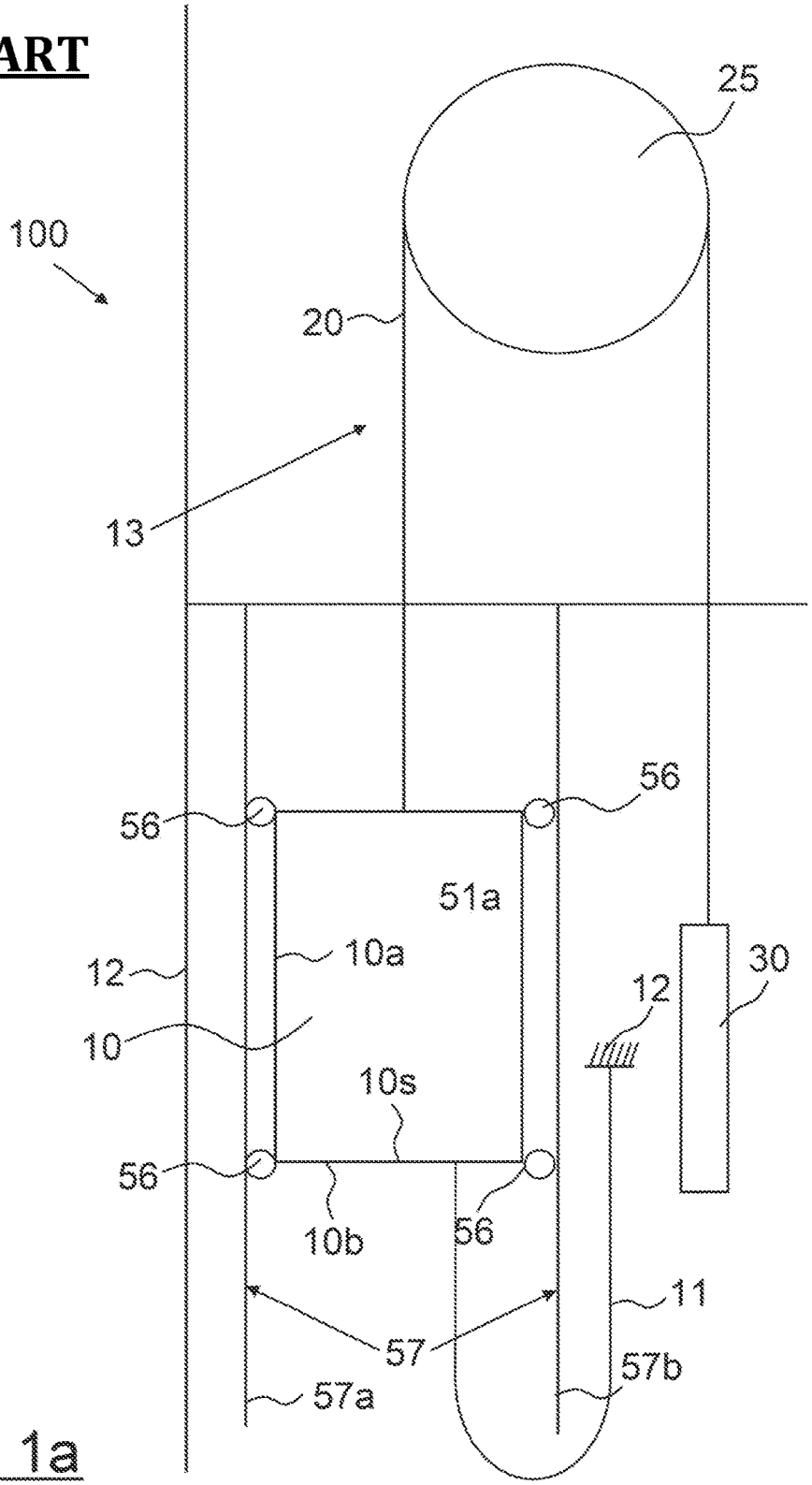
FIG. 1*a* is a schematic view of a prior art elevator installation.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Example elevator systems may generally have an elevator cage that is displaceable in an elevator shaft and a connection means that has first and second elevator cage-side ends. The first end of the connection means may in some cases be fastened to a suspension on the elevator cage. Further, those having ordinary skill in the art will understand that the term 'installation' may be used interchangeably with the term 'system.'

Furthermore, in some examples, an elevator system may have at least one elevator cage that is displaceable in an elevator shaft, wherein a connection means is connected to the elevator cage and a first elevator cage-side end of the connection means is fastened to a suspension on the elevator cage. A second end of the connection means may be fastened in or to the elevator shaft, for example. Alternatively, the second end of the connection means may be fastened to the counterweight.

The elevator installation according to the invention furthermore comprises an additional rope, wherein the additional rope is fastened to the suspension in such a manner that, on account thereof, a force that counteracts a weight force acting on the suspension by way of the connection means is exerted on the suspension.

The elevator cage here is connected to a counterweight in particular by way of a support rope. In particular, the support rope is guided over at least one drive pulley and/or deflection rollers or run-off rollers, respectively.

The connection means is preferably a suspended cable. The suspended cable serves in particular for supplying power to the elevator cage. Furthermore, the suspended cable possesses functions of a data cable in particular. By means of the suspended cable in particular data are thus transmitted to the elevator cage or from the elevator cage, respectively, and the elevator cage may be controlled by way of the suspended cable. The suspended cable here comprises in particular a plurality of individual lines which are assembled to form the suspended cable.

Alternatively, the connection means is a support-rope weight compensation means. The support-rope weight compensation means serves for equalizing the masses of the support means. The weight force acting on the drive pulley and/or deflection rollers or run-off rollers, respectively, varies depending on the position of the elevator cage, in particular in the case of great conveying heights. As soon as the elevator cage is in a lower position, the support means are substantially on the elevator cage side. However, if the elevator cage is at the upper end of the shaft, the support means are then substantially on the side of the counterweight. This variation leads to variable stress on the drive pulley and on the rollers. This variation is typically compensated for by a support-rope weight compensation means connecting the elevator cage to the counterweight. Depending on the position of the elevator cage, the support-rope weight compensation means now likewise switches between the elevator cage side and the counterweight side and in this manner compensates for the variation by way of the weight force of the support means.

The invention here is suitable for elevator installations having only one elevator cage as well as for elevator installations having a plurality of elevator cages, in particular a plurality of elevator cages within one elevator shaft.

Advantages of the Invention

The first end of the connection means is not fastened directly to the elevator cage but to a suspension which is configured on said elevator cage. The suspension is in particular at least partially de-linked from the elevator cage.

In one variant, the connection means is a suspended cable. The suspension here is in particular designed in such a manner that the suspended cable or the individual lines of the suspended cable, respectively, are routed into the elevator cage. The suspended cable or the individual lines, respectively, in the elevator cage and/or on the shaft side are connected to corresponding construction elements, for example to control equipment, in particular. The supply of power or the transmission of data, respectively, is thus guaranteed by means of the suspended cable. A second end of the suspended cable is fastened in a conventional manner in the elevator shaft, in particular to a wall or to the ceiling of the elevator shaft. It is particularly expedient for the first end of the suspended cable to be fastened to the wall in the center of the vertical extent of the elevator shaft.

On account of the mass thereof, the connection means exerts a weight force on the suspension. This weight force of the connection means here acts on the suspension in a vertically downward direction. According to the invention, a support unit which exerts a force on the suspension that counteracts the weight force of the connection means acts on the suspension. The force acting by way of the support unit on the suspension will hereunder also be referred to as an additional force. The weight force of the connection means and the additional force here are in particular in an equilibrium of forces. In particular, a direction of the weight force and a direction of the additional force are thus mutually opposed. In particular, the values for the weight force and for the additional force are identical.

The support unit serves for compensating the weight force of the connection means. The weight force of the connection means is received by way of the support unit. Any torque which could be exerted by a connection means without a support unit of this type on an elevator cage is eliminated. It is thus in particular prevented that a non-uniform distribution of force and/or momentum is exerted on a guide and/or on guide rollers of the elevator cage. Non-uniform stress on the guide rollers by way of the connection means is thus effectively compensated for. Here, this compensation of the weight force of the connection means is optimal not only in one specific position of the elevator cage in the elevator shaft, but in any potential position of the elevator cage in the elevator shaft. On account thereof, the service life of the guide rollers is increased, for example, and repair or maintenance costs, respectively, are reduced. Furthermore, it is guaranteed that the elevator cage in any potential position in the elevator shaft is precisely balanced, enhancing traveling properties and travel comfort.

The support unit expediently lies at least partially or completely outside the vertical projection of the elevator cage. By way of this measure, the lower side of the elevator cage may be kept substantially free of units for fastening the connection means.

According to one preferred design embodiment of the elevator installation according to the invention, the support unit has an additional rope, one or a plurality of deflection rollers, and a counterweight, wherein the second end of the additional rope is fastened to the counterweight. The additional rope here is guided over the deflection roller(s). Speaking illustratively, the counterweight here receives the weight force of the connection means. The additional rope is thus tensioned by the connection means. The weight force of the connection means is transferred to the counterweight by way of the additional rope. In particular, a counterweight of the elevator cage that is already present anyway may be utilized as the counterweight for compensating for the weight force of the connection means. On account thereof, the additional rope may also be accommodated in a space-saving manner in the elevator shaft. The deflection roller of the support unit is preferably fastened in a machine room and/or in the shaft head of the elevator shaft. The additional rope may also be composed of a plurality of ropes or be embodied in the form of a belt.

It is particularly preferable that the suspension in relation to the elevator cage is configured so as to be movable, in particular vertically movable. By way of play which is thus made available to the suspension in relation to the elevator cage, de-linking of the connection means from the elevator cage is implementable. Variable elongation stresses between the support rope of the elevator cage and the additional rope during operation may thus be equalized.

The connection means is thus capable of being completely de-linked from the elevator cage, such that a guide, in particular guide rollers of the elevator cage, is/are not stressed. The elevator cage here is connected to the counterweight by way of the support rope and the drive pulley, or by one or a plurality of deflection rollers, respectively. The counterweight is connected to the connection means in an analogous manner. It is thus guaranteed that no additional stress acts on the guide rollers of the elevator cage.

A tensioning mass is preferably provided. This tensioning mass may preferably be attached to a fastening element or to a slide of the suspension. The additional rope is at all times tensioned in an optimal manner by the tensioning mass. While the additional rope is also tensioned by the connection means or (at least partially) tensioned by the weight force of the connection means, respectively, this tensioning of the additional rope by way of the connection means becomes less as the position of the elevator cage in the elevator shaft becomes lower. If the elevator cage is in the lowermost position, a correspondingly minor weight force of the connection means acts on the additional rope. In the lowest position of the elevator cage, the additional rope is thus not at all or only very slightly tensioned by the connection means. It is guaranteed by way of the tensioning mass that the additional rope is at all times under the tension required for faultless operation.

The additional rope is preferably fastened to the counterweight at a rope suspension ratio of 1:1. On account thereof, traveling noises and vibrations of the elevator cage as well as noises of the deflection roller(s) and of the additional rope are kept low in the elevator cage, even at comparatively high speeds. It should be noted that 2:1-type suspensions are also employable in the context described.

The additional rope is preferably configured from carbon fibers. A configuration as a plastics rope or as a metal rope (in particular as a steel rope) is also possible in an advantageous manner. An embodiment as a belt is also possible. In particular, the additional rope is configured from a strong, hard-wearing, and tear-resistant but nevertheless elongatable material. The additional rope must be designed in such a manner that it can compensate for the weight force of the complete connection means, in particular when the elevator cage is at the highest position. Here, a large difference in the stress on the additional rope by way of the connection means arises between the highest and lowest position of the elevator cage. This difference in particular leads to elongation of the additional rope. Carbon fibers are particularly expedient for withstanding this stress.

The at least one elevator cage expediently has a guide unit on which the elevator cage is displaceable in the elevator shaft. In this context, linear guides, in particular sliding guides, magnetic guides, pneumatic guides, etc. are particularly preferable.

It is particularly preferable that the elevator cage is configured having a number of guide rollers which interact with an elevator cage guide provided in the shaft, which in particular has a number of elevator cage rails. So that non-uniform forces and momentums acting on the elevator cage guide or on the guide rollers, respectively, may be avoided according to the invention, guide rollers of this type may be manufactured from particularly soft materials, such as from plastics or rubber, for example, on account of which the travel comfort of an elevator installation may be improved. In this context, metal rollers having a covering of soft plastics are also conceivable as guide rollers.

According to one preferred design embodiment of the invention, in order for the mentioned mobility in terms of the elevator cage to be provided, the suspension has a vertically displaceable slide or at least one articulation outside or partially outside the elevator cage projection. Other vertically movable elements are also conceivable. As an example, pivot mechanisms or articulation mechanisms which are provided on an elevator wall cage are to be mentioned.

According to a second preferred design embodiment, the suspension to this end has a rotatably mounted lever which is in particular pivotably mounted on the lower side or the upper side of the elevator cage (that is to say within the elevator cage projection) and which extends out of the elevator cage projection into a region beside the elevator cage projection).

These two preferred design embodiments make available in a simple manner in terms of construction desirable vertical play between the suspension and the elevator cage, such that changing weight forces on account of the connection means may be compensated for depending on the position of the elevator cage. On account thereof, variable elongation behavior of the support rope and of the additional rope is likewise effectively compensated for.

These preferred design embodiments will be discussed in detail hereunder with reference to the figures.

Further advantages and design embodiments of the invention are derived from the description and from the appended drawing.

It is to be understood that the features mentioned above and those yet to be discussed hereunder are not only able to be used in the combination stated in each case but also in other combinations or individually, without departing from the scope of the present invention.

FIG. 1*a* shows a schematic illustration of an elevator installation 100. Here, an elevator cage 10 is suspended from a support rope 20. The elevator cage is displaceable within the elevator shaft 12 which is only schematically indicated. The elevator cage 10 has elevator cage walls of which one is referenced with 10*a*, and an elevator cage lower side 10*b*. A centric region of the lower side 10*b* or of the elevator cage base, respectively, that corresponds to the center of gravity of the elevator cage, is referenced with 10*s*. The support rope 20 is guided over a drive pulley 25 (and optionally over deflection rollers not illustrated in detail) and is connected to a counterweight 30. The drive pulley 25 here is schematically illustrated and may also comprise a plurality of individual rollers. The elevator cage is configured having guide rollers 56 which are displaceable along an elevator cage guide 57 which has rails 57*a*, 57*b*, for example. According to the invention, the guide rollers 56 may be manufactured from a very soft material or else have a covering of a very soft material, for example suitable plastics.

A connection means 11 is provided on the lower side of the elevator cage 10*b*. The first elevator cage-side end of the connection means 11 here is disposed on the elevator cage 10. The second end of the connection means may either be disposed on the counterweight 30 (not illustrated) or on the shaft 12. The connection means may be a suspended cable or a balance chain. Should the connection means be a suspended cable, the second end is typically connected to the shaft 12. However, should the connection means 11 be a balance chain, the second end is typically connected to the counterweight 30. The issue of a variable proportion of the weight force of the connection means 11 acting on the elevator cage, depending on the position of the elevator cage 10, arises in both cases. The higher the position of the elevator cage 10 in the shaft, the higher the proportion of the weight force of the connection means 11 acting on the elevator cage. On account of the required bending radius of the connection means 11, the first end of the connection means is mostly disposed in a decentralized manner and thus not in the center of gravity 10*s* of the elevator cage base. Depending on the position of the elevator cage in the elevator shaft 10, there thus results non-uniform distribution of the force and momentum on the guide rollers 56.

Figure 1:
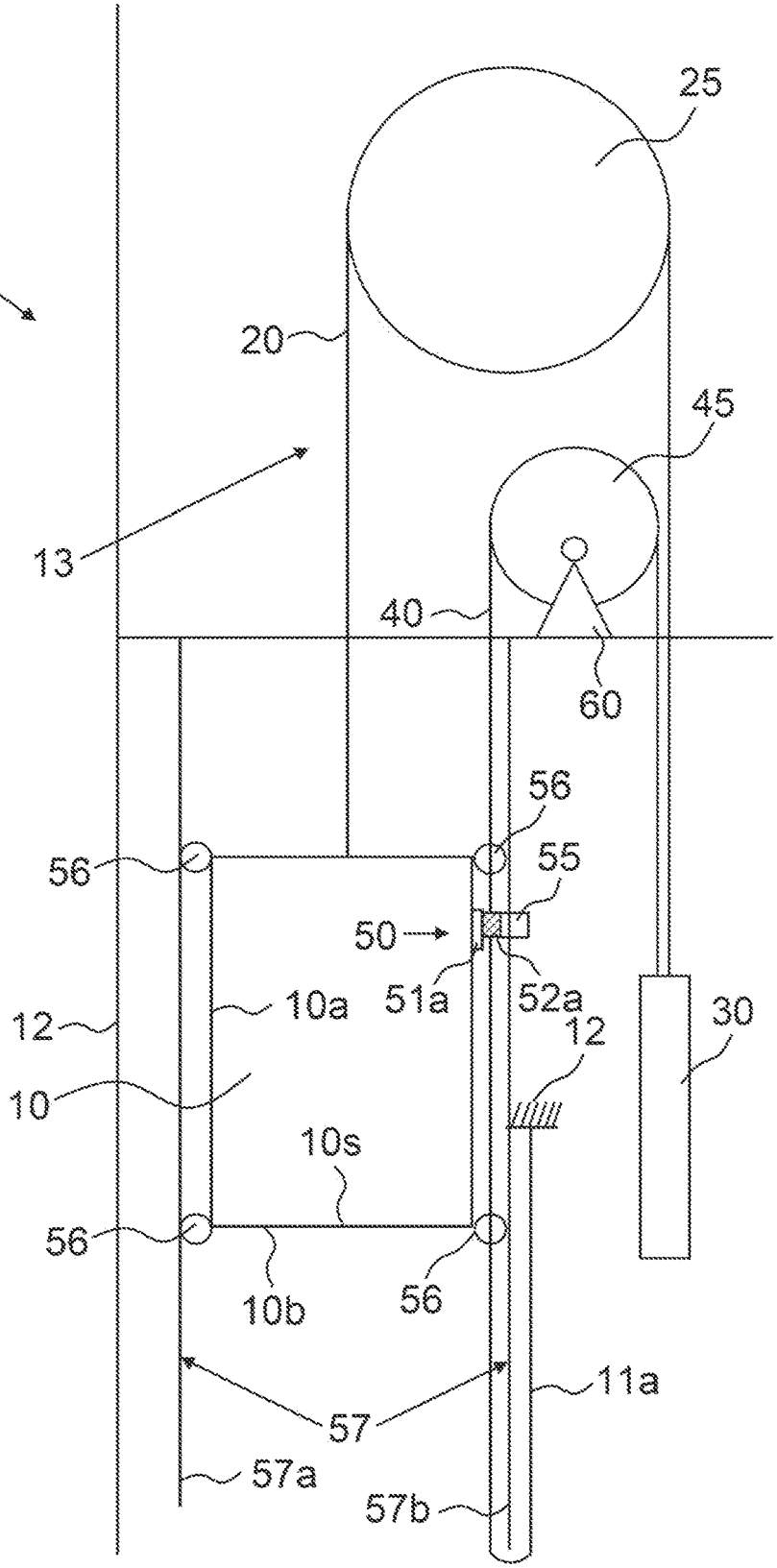
FIG. 1 is a schematic view of an example elevator system of the present disclosure.

A preferred design embodiment of an elevator installation according to the invention is schematically illustrated in FIG. 1 and referenced with 100. In this embodiment, the connection means is configured as a suspended cable 11*a*.

An elevator cage 10 is suspended from a support rope 20. The elevator cage 10 has vehicle walls of which one is referenced with 10*a*, and a lower side of the elevator cage 10*b*. A centric region of the lower side 10*b* or of the elevator cage base, respectively, which corresponds to the center of gravity of the elevator cage, is referenced with 10*s*. The support rope 20 is guided over a drive pulley 25 (and optionally over deflection or deflection rollers not illustrated in detail), and is connected to a counterweight 30. The drive pulley 25 here is schematically illustrated and may also comprise a plurality of individual rollers. The elevator cage is configured having guide rollers 56 which are displaceable along an elevator cage guide 57 which has rails 57*a*, 57*b*, for example. According to the invention the guide rollers 56 may be manufactured from a very soft material, or else have a covering of a very soft material, for example suitable plastics.

A suspended cable 11*a* serves for supplying the elevator cage 10 with electric power and for exchanging data. A first end of the suspended cable 11*a* is fastened in the elevator shaft. The elevator shaft here for reasons of clarity is only schematically indicated by the reference sign 12. The suspended cable 11*a* in particular is fastened to a wall of the elevator shaft 12. The other end of the suspended cable 11*a* is not directly fastened to the elevator cage 10 in a mechanical manner but is connected to a suspension 50 which is configured on the elevator cage 10.

In FIG. 1 the suspension 50 is configured according to a first preferred design embodiment of the invention. The suspension 50 here comprises a slide 51*a* which is vertically displaceable in a guide on the elevator cage 10, and a fastening element 52*a* which is configured on said slide 51*a*. It is to be noted that other elements which make available vertical mobility are also usable. For example, a lever which is pivotable on the wall of the elevator cage may be provided in place of the slide 51*a*. The suspended cable 11*a* is fastened to the fastening element 52*a* or is suspended therefrom, respectively. On account of the vertical displaceability of the slide 51*a*, the fastening element 52*a* here is de-linked from the elevator cage 10 in terms of vertical force. The vertically displaceable slide 51*a* furthermore serves for horizontal guiding of the suspended cable 11*a*. The suspended cable 11*a* is secured by way of the suspension 50, and the supply of electric power to the elevator cage 10 and the exchange of data therewith is thus guaranteed.

Furthermore, an additional rope 40 is fastened to the fastening element 52*a*. The additional rope 40 serves for compensating for the weight force of the suspended cable 11*a*. The weight force of the suspended cable 11*a* acts on the suspension 50 in the vertical downward direction, when viewed using the example of FIG. 1. The additional rope 40 is now fastened to the suspension 50 and in the elevator shaft in such a manner that a force acts on the suspension 50 that counteracts the weight force of the suspended cable 11*a*, as is to be discussed hereunder. This force is thus intended to act on the suspension in a vertical upward direction.

The additional rope 40 is guided over at least one deflection roller 45. A plurality of deflection rollers 45 may also be provided for the additional rope. In particular, two deflection rollers 45 are typically provided here. The additional rope 40 is furthermore fastened to the counterweight 30. The deflection rollers (and/or the drive pulley 25) are/is preferably fastened in the machine room 13 or else in the shaft head, this in FIG. 1 being indicated by the reference sign 60. It is likewise possible for the deflection roller 45 and/or the drive pulley 25 to be provided in a machine room in the shaft head. Preferably, the additional rope 40 is guided toward the counterweight 30 at a rope suspension ratio of 1:1. 2:1-type suspensions are also conceivable.

The additional rope 40 or the counterweight 30, respectively, compensates for the weight force of the suspended cable 11*a*. The weight force of the suspended cable 11*a* is thus de-linked from the elevator cage 10. The vertically displaceable slide 51*a* is preferably configured so as to be displaceable in a bearing-type guide, in a sliding guide, or in a spindle roller bearing on the elevator cage 10. In the case of a lever providing vertical displaceability, a rotary joint provided on the elevator cage wall is advantageously employable. On account of the suspension 50 being configured having the vertically displaceable slide 51*a* and the fastening element 52*a*, it is guaranteed that no force acting in the vertical direction is introduced onto the elevator cage 10 and consequently no resulting torque generates any force acting on the guide rollers 56.

The additional rope 40 is tensioned by the weight force of the suspended cable 11*a* that acts on the additional rope 40. Additionally, a tensioning mass 55 may also be fastened to the fastening element 52*a*. By way of the tensioning mass 55 it is ensured that the additional rope 40 is optimally tensioned at every position of the elevator cage 10 in the elevator shaft 12.

Figure 2:
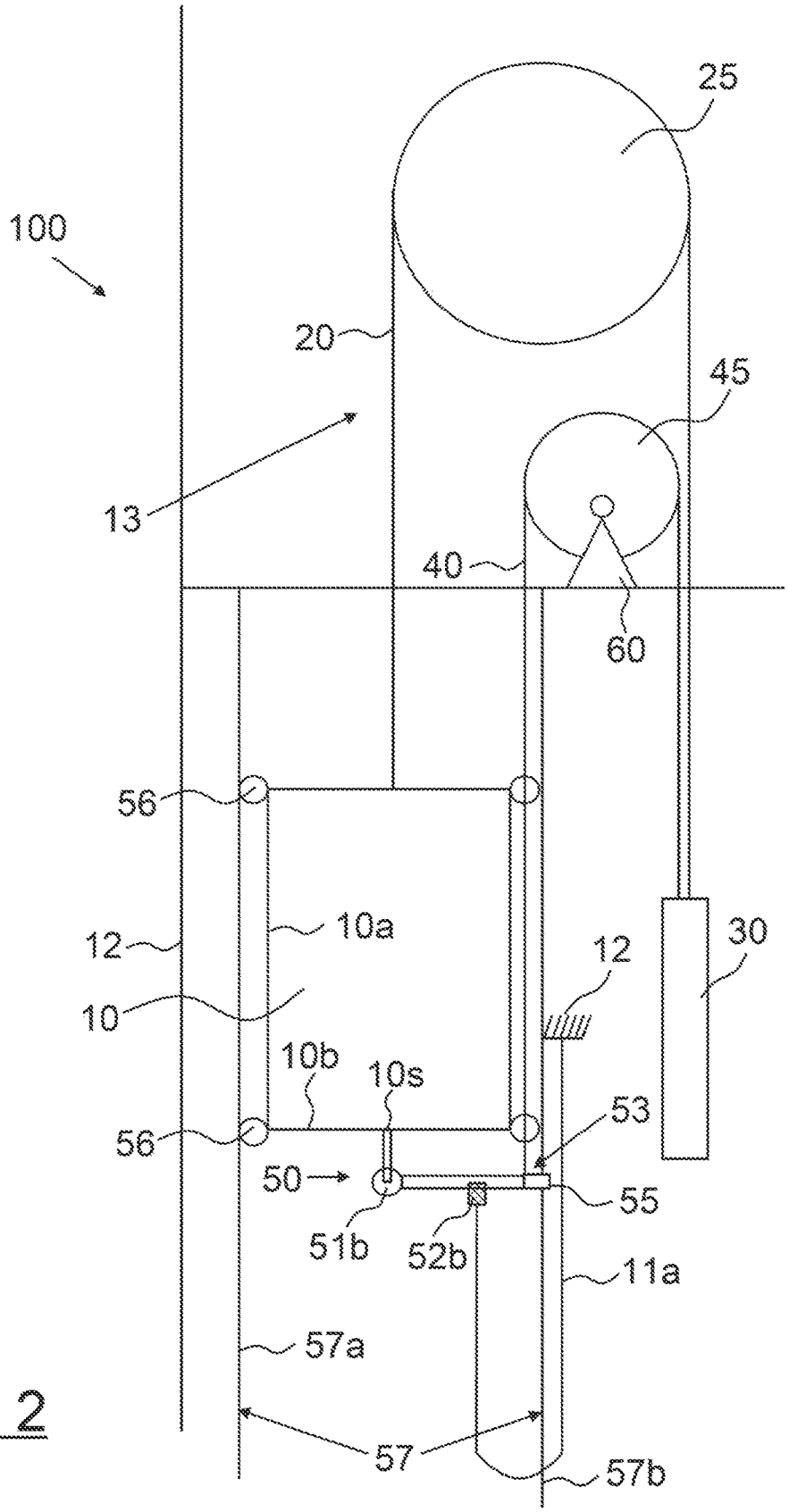
FIG. 2 is a schematic view of another example elevator system.

An elevator installation 100 is illustrated in FIG. 2 in an analogous manner to FIG. 1. Same reference signs here refer to identical or equivalent elements, and are not explained again.

A suspension 50 according to the second preferred design embodiment of the invention is illustrated in FIG. 2. The suspension 50 has a lever 51*b*, which is rotatably mounted on the lower side of the elevator cage 10, and a suspension 52*b*. The suspended cable 11*a* is fastened to the suspension 52*b* or is suspended therefrom, respectively. The additional rope 40 is fastened to one end 53 of the rotatably mounted lever 51*b*. A tensioning mass 55 which preferably is configured on the rotatably mounted lever, in particular on the end 53 thereof, may also be provided in this design embodiment.

The rotatably mounted lever 51*b* is preferably fastened in a centric region 10*s* on the lower side 10*b* of the elevator cage 10. According to this design embodiment of the suspension 50, depending on the positioning of the suspension 52*b*, a corresponding proportion of the weight force of the suspended cable 11*a* is introduced into the elevator cage. On account of the rotatably mounted lever 51*b* being fastened in the centric region 10*s*, this part of the weight force of the suspended cable 11*a* is however introduced into the elevator cage 10 in a centrical manner. The other proportion of the weight force is received by way of the additional rope 40. Thus, no undesirable torque acting on the elevator cage 10 by way of the weight force of the suspended cable 11*a* is created. There is thus no non-uniform distribution of force or non-uniform stress on the guide rollers 56, respectively.

Also on account of this design embodiment of the suspension 50, having the rotatably mounted lever 51*b* and the suspension 52*b*, no force acting in the vertical direction is introduced onto the elevator cage 10. A proportion of the weight force of the suspended cable 11*a* is compensated for by the additional rope 40, which in turn is guided over at least one deflection roller 45, also in this design embodiment. Part of the weight force of the suspended cable 11*a* is introduced into the elevator cage 10 in a centrical manner. Thus, the guide rollers 56 of the elevator cage 10 also according to this embodiment are in the optimal case not at all stressed but in any case only stressed to a minimum by the weight force of the suspended cable, depending on changing positions of the elevator cage.

Figure 3:
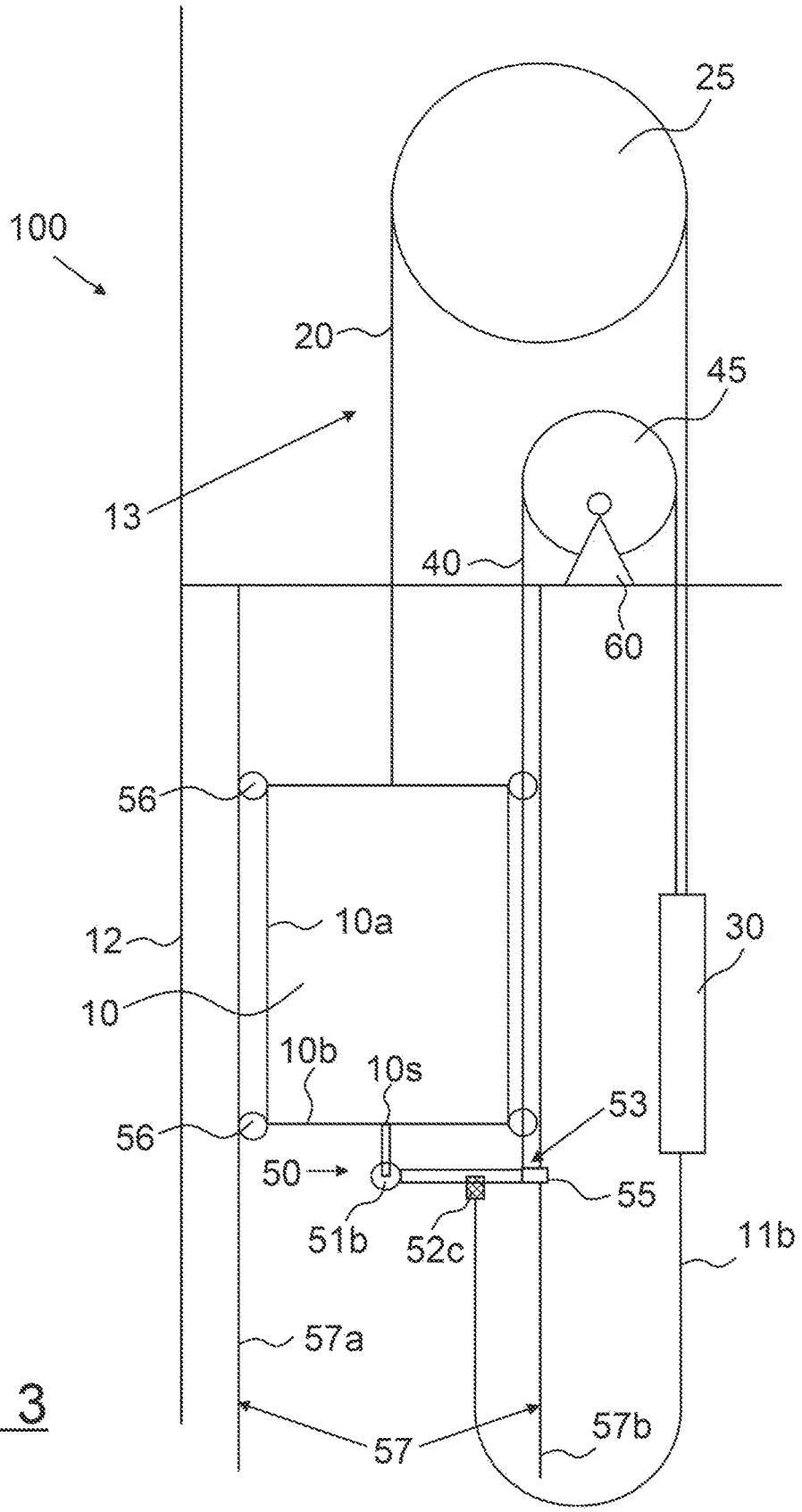
FIG. 3 is a schematic view of an example elevator system having an example balance chain as a support-rope weight compensation means.

An elevator installation 100 is illustrated in FIG. 3 in an analogous manner to FIG. 2. Same reference signs here refer to identical or equivalent elements, and are not explained again. In this embodiment the connection means is configured as a balance chain 11*b*. The first elevator cage-side end of the balance chain 11*b* is connected to the suspension 50. The second end of the balance chain 11*b* is connected to the counterweight 30. Thus, the balance chain 11*b* compensates for the changing stress by the weight force of the support rope 20 in the case of changing positions of the elevator cage.

The suspension 50 has a lever 51*b* which is rotatably mounted on the lower side of the elevator cage 10, and a suspension 52*c*. The balance chain 11*b* is fastened to the suspension 52*c* or is suspended therefrom, respectively. The additional rope 40 is fastened to one end 53 of the rotatably mounted lever 51*b*. A tensioning mass 55 which preferably is configured on the rotatably mounted lever, in particular on the end 53 thereof, may also be provided in this design embodiment.

The rotatably mounted lever 51*b* is preferably fastened in a centric region 10*s* on the lower side 10*b* of the elevator cage 10. According to this design embodiment of the suspension 50, depending on the positioning of the suspension 52*b*, part of the weight force of the balance chain 11*b* is introduced into the elevator cage. On account of the rotatably mounted lever 51*b* being fastened in the centric region 10*s*, this part of the weight force of the balance chain is however introduced into the elevator cage 10 in a centrical manner. Thus, no undesirable torque acting on the elevator cage 10 by the weight force of the balance chain 11*b*, generating a force acting on the guide rollers 56, is created. There is thus no non-uniform distribution of force or non-uniform stress on the guide rollers 56, respectively.

Also on account of this design embodiment of the suspension 50, having the rotatably mounted lever 51*b* and the suspension 52*c*, no force acting in the vertical direction is introduced onto the elevator cage 10. A proportion of the weight force of the balance chain 11*b* is compensated for by the additional rope 40, which in turn is guided around at least one deflection roller 45, also in this design embodiment. The other proportion of the weight force of the balance chain 11*b* is introduced into the elevator cage 10 in a centrical manner. Thus, the guide rollers 56 of the elevator cage 10 also according to this embodiment are in the optimal case not at all stressed but in any case only stressed to a minimum by the weight force of the balance chain 11*b*, depending on changing positions of the elevator cage.

Figure 4:
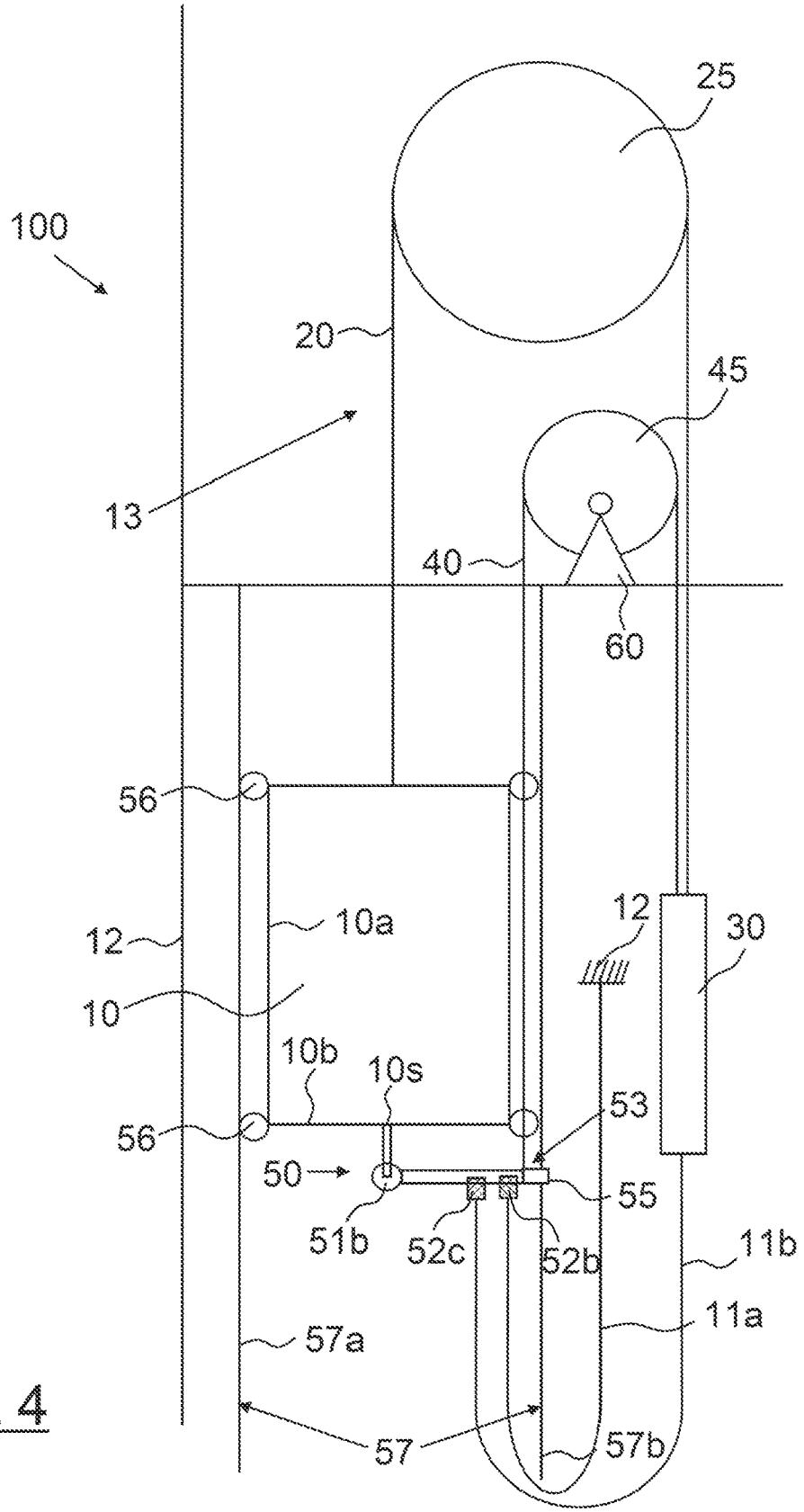
FIG. 4 is a schematic view of an example elevator system having an example suspended cable and an example balance chain as a support-rope weight compensation means.

An elevator installation 100 is illustrated in FIG. 4 in an analogous manner to FIGS. 2 and 3. Same reference signs here refer to identical or equivalent elements, and are not explained again. This embodiment comprises both a suspended cable 11*a* as well as a balance chain 11*b* as connection means.

The suspension 50 has a lever 51*b* which is rotatably mounted on the lower side of the elevator cage 10. Both the suspended cable 11*a* as well as the balance chain 11*b* are fastened to the same lever 51*b*. To this end, the lever 51*b* has a suspension 52*b* for the suspended cable 11*a*, and a suspension 52*c* for the balance chain 11*b*. The in each case first elevator cage-side end of the suspended cable 11*a* or of the balance chain 11*b* is fastened to the two suspensions 52*b* and 52*c*, respectively. The second end of the suspended cable 11*a* is connected to the shaft 12. The second end of the balance chain 11*c* is connected to the counterweight. The additional rope 40 is fastened to an end 53 of the rotatably mounted lever 51*b*. A tensioning mass 55 which preferably is configured on the rotatably mounted lever, in particular on the end 53 thereof, may also be provided in this design embodiment.

The rotatably mounted lever 51*b* is preferably fastened in a centric region 10*s* on the lower side 10*b* of the elevator cage 10. According to this design embodiment of the suspension 50, depending on the positioning of the suspensions 52*b* and 52*c*, part of the weight force of the suspended cable 11*a* and of the balance chain 11*b* is introduced into the elevator cage. On account of the rotatably mounted lever 51*b* being fastened in the centric region 10*s*, this proportion of the weight force is however introduced into the elevator cage 10 in a centrical manner. Thus, no undesirable torque acting on the elevator cage 10 by the weight force of the two connection means, generating a force acting on the guide rollers 56, is created. There is thus no non-uniform distribution of force or non-uniform stress on the guide rollers 56, respectively.

Also on account of this design embodiment of the suspension 50, having the rotatably mounted lever 51*b* and the suspensions 52*b* and 52*c*, no force acting in the horizontal direction is introduced onto the elevator cage 10. A proportion of the weight force of the two connection means, the suspended cable 11*a* and the balance chain 11*b*, is compensated for by the additional rope 40, which in turn is guided around at least one deflection roller 45, also in this design embodiment. Thus, the guide rollers 56 of the elevator cage 10 also according to this embodiment are in the optimal case not at all stressed but in any case only stressed to a minimum by the weight force of the suspended cable 11*a* and of the balance chain 11*b*, depending on changing positions of the elevator cage.

What is claimed is:

1. An elevator system comprising:

a support rope;

an elevator cage that is suspended from the support rope and displaceable in an elevator shaft;

a suspension disposed on the elevator cage;

a connection means that has a first end and a second end, wherein the first end is closer to the elevator cage than the second end and is immovably fixed to the suspension on the elevator cage; and a support unit that is positioned at least partially outside a vertical projection of the elevator cage, wherein the support unit comprises an additional rope that is fastened to the suspension, such that the support unit exerts a first force on the suspension, which first force counteracts a second force acting on the suspension, wherein the second force acts downwards and is attributable to a weight of the connection means, wherein the additional rope is fastened to the suspension in a position outside the vertical projection of the elevator cage.

2. The elevator system of claim 1 wherein the suspension is vertically movable relative to the elevator cage.

3. The elevator system of claim 1, wherein the support unit further comprises a deflection roller and a counterweight, wherein a first end of the additional rope is fastened to the counterweight, and the additional rope is guided over the deflection roller.

4. The elevator system of claim 3, wherein the rope is suspended at a rope suspension ratio of 1:1.

5. The elevator system of claim 3, wherein the rope is comprised of carbon fibers.

6. The elevator system of claim 1 wherein the suspension comprises a slide that is vertically displaceable on the elevator cage.

7. The elevator system of claim 6 wherein the slide is configured so as to be displaceable in a bearing-type guide, in a sliding guide, or in a spindle roller bearing.

8. The elevator system of claim 1 wherein the suspension comprises a rotatably mounted lever.

9. The elevator system of claim 8 wherein the lever is rotatably mounted on a lower side of the elevator cage in a centric region of a base of the elevator cage or on a wall of the elevator cage.

10. The elevator system of claim 8 further comprising a tensioning mass disposed on the rotatably mounted lever or on a fastening element that fastens the first end of the connection means to the suspension on the elevator cage.

11. The elevator system of claim 1, wherein the support unit further comprises a deflection roller and a counterweight, wherein a first end of the additional rope is fastened to the counterweight, and the deflection roller is disposed in a machine room and/or a shaft head of the elevator shaft.

12. The elevator system of claim 1 further comprising a plurality of guide rollers disposed along the elevator cage, wherein the plurality of guide rollers interact with an elevator cage guide disposed in the elevator shaft.

13. The elevator system of claim 1 wherein the connection means comprises a suspended cable, wherein the second end of the connection means is connected to the elevator shaft.

14. The elevator system of claim 1 wherein the connection means comprises a balance chain or a balance belt.

15. An elevator system comprising:

a support rope;

an elevator cage that is suspended from the support rope and displaceable in an elevator shaft, the elevator cage having a top, a bottom, and vertical sides that extend between the top and the bottom;

a suspension disposed on one of the vertical sides of the elevator cage;

a connection means for supplying power to the elevator cage, the connection means being fastened to the suspension on the elevator cage;

an additional rope that is fastened to the suspension and exerts a first force on the suspension that counteracts a second force acting on the suspension, the second force acting downwards and being attributable to a weight of the connection means; and a support unit that is coupled to the additional rope, wherein a weight of the support unit contributes to the first force that the additional rope exerts on the suspension.

16. The elevator system of claim 15 wherein the support unit is positioned outside a vertical projection of the elevator cage.

17. The elevator system of claim 15 wherein the suspension is vertically movable relative to the elevator cage.

18. An elevator system comprising:

a support rope;

an elevator cage that is suspended from the support rope and displaceable in an elevator shaft;

a suspension disposed outside a vertical projection of the elevator cage, the suspension comprising a slide that is vertically displaceable relative to the elevator cage;

a connection means for supplying power to the elevator cage, the connection means being fastened to the suspension; and an additional rope that is fastened to the suspension and exerts a first force on the suspension that counteracts a second force acting on the suspension, the second force being attributable to a weight of the connection means.

* * * * *